US008215927B2

(12) United States Patent
Niwa et al.

(10) Patent No.: US 8,215,927 B2
(45) Date of Patent: Jul. 10, 2012

(54) FLUID PRESSURE PUMP UNIT

(75) Inventors: Hideki Niwa, Gifu (JP); Teruhiko Yoshioka, Gifu (JP)

(73) Assignee: Nabtesco Corporation, Tokyo (JP)

( * ) Notice: Subject to any disclaimer, the term of this patent is extended or adjusted under 35 U.S.C. 154(b) by 565 days.

(21) Appl. No.: 12/411,068

(22) Filed: Mar. 25, 2009

(65) Prior Publication Data

US 2009/0246044 A1 Oct. 1, 2009

(30) Foreign Application Priority Data

Mar. 26, 2008 (JP) ..... 2008-080027

(51) Int. Cl.
*F04B 39/06* (2006.01)
*F04B 39/12* (2006.01)

(52) U.S. Cl. ..... 417/372; 417/366; 417/377

(58) Field of Classification Search ..... 417/372, 417/366–371, 373, 377, 423.7, 423.8, 423.14
See application file for complete search history.

(56) References Cited

U.S. PATENT DOCUMENTS 2,787,720 A * 4/1957 Ethier et al. ..... 310/57
6,146,113 A 11/2000 Fassnacht et al.
6,592,336 B1 * 7/2003 Hirano et al. ..... 417/201
2008/0024020 A1 1/2008 Iund et al.

FOREIGN PATENT DOCUMENTS

| | | |
|---|---|---|
| DE | 37 05 909 A1 | 9/1988 |
| DE | 269 09 701 U1 | 8/1996 |
| EP | 0 374 739 A1 | 6/1990 |
| EP | 1 179 677 A1 | 2/2002 |
| JP | 10-68142 | 3/1998 |

OTHER PUBLICATIONS

European Search Report for European Application No. 09156159.7-1267, mailed on May 26, 2009 (6 pages).

* cited by examiner

*Primary Examiner* — Joseph L Williams
*Assistant Examiner* — Nathaniel Lee
(74) *Attorney, Agent, or Firm* — Osha • Liang LLP

(57) ABSTRACT

The present invention provides a technology for downsizing fluid pressure equipment including a fluid pressure pump and a radiator. The hydraulic pump unit 3 includes: a hydraulic pump 4; a motor 5 which drives the hydraulic pump 4; a cooling fan 7 which is connected to an output shaft 5*a* of the motor 5 and generates a flow of cooling air 6 to cool the motor 5; and a radiator 8 which receives heat from the hydraulic oil. The motor 5 and the radiator 8 are overlapped with the cooling fan 7, when viewed from the axial direction of the output shaft 5*a* of the motor 5.

5 Claims, 4 Drawing Sheets

FLUID PRESSURE PUMP UNIT

TECHNICAL FIELD

The present invention relates to a fluid pressure pump unit.

BACKGROUND OF THE INVENTION

Patent document 1 (JP10-68142A) discloses this type of technology in its paragraph 0002. Specifically, the paragraph describes, as a known-art, that engines and radiators in general are cooled by driving an engine and a fan directly connected to the engine so as to generate a flow of cooling air for cooling the engine and the radiator.

SUMMARY OF THE INVENTION

Problems to be Solved by the Invention

Fluid pressure equipment in general has a radiator for cooling hydraulic fluid, the radiator being disposed in a position apart from a fluid pressure pump. A cooling fan for cooling the radiator is additionally installed. Today, downsizing of the fluid pressure equipment is required for the purpose of improving the maintenance characteristic of the fluid pressure equipment itself or peripherals thereof.

The present invention is made in view of the problems, and is mainly intended to provide a technology for downsizing fluid pressure equipment including a fluid pressure pump and a radiator.

Means for Solving the Problem

The technical problem to be solved by the present invention is as described above, and means to solve the problem and its effect is described hereinbelow.

The first aspect of the present invention provides a fluid pressure pump unit structured as follows. Namely, the fluid pressure pump unit includes: a fluid pressure pump which pressurizes a hydraulic fluid; a motor which has an output shaft and drives the fluid pressure pump; a cooling fan which is connected to the output shaft of the motor and generates a flow of cooling air to cool the motor; and a radiator which receives heat from the hydraulic fluid. The motor and the radiator are overlapped at least partially with the cooling fan, when viewed from an axial direction of the output shaft of the motor. In this structure, the flow of cooling air is utilized not only for cooling the motor but also for cooling the radiator, thereby contributing to downsizing of the fluid pressure equipment.

Note that "radiator" in Patent document 1 is a member for cooling an engine. On the other hand, the "radiator" in the present invention is a member for cooling the hydraulic fluid, rather than a member for cooling the motor (corresponding to the engine). That is, the technical significance of "radiator" which is an essential element of the present invention is very different.

Further, the fluid pressure pump unit is structured as follows. Namely, the radiator is disposed between the cooling fan and the motor. This structure, which gives more priority to cooling of the radiator over cooling of the motor, excels in cooling the hydraulic fluid.

Further, the fluid pressure pump unit is structured as follows. Namely, the fluid pressure pump is disposed at the opposite side of the radiator across the motor. A passage in the fluid pressure pump and a passage in the radiator are in communication with each other through a communication passage formed in the motor. In the above structure, a special plumbing communicating the passage in the fluid pressure pump with the passage in the radiator is formed in the motor. This structure contributes to weight reduction and improvement of maintenance characteristic, compared to a case of providing the plumbing outside the motor.

Further, the fluid pressure pump unit is structured as follows. Namely, the communication passage is formed in a housing of the motor. Although the communication passage is formed inside the motor, the basic operation of the motor is not affected. Further with the structure, heat is transferred from the hydraulic fluid flowing in the communication passage to the housing of the motor, thereby contributing to cooling of the hydraulic fluid.

Further, the fluid pressure pump unit is structured as follows. Namely, the housing of the motor includes a first housing and a second housing fitted at the outside of the first housing. At least a part of the communication passage includes a groove as its constituting element, the groove being formed on one of an outer circumferential surface of the first housing and an inner circumferential surface of the second housing. This structure allows easier formation of the communication passage.

Further, the fluid pressure pump unit is structured as follows. Namely, the communication passage is formed so as to make a detour inside the housing of the motor. This structure ensures a large contact area between the hydraulic fluid flowing in the communication passage and the housing of the motor, thereby enhancing heat transfer from the hydraulic fluid to the housing.

Further, the fluid pressure pump unit is structured as follows. Namely, a first radiation fin extending in the axial direction of the output shaft is formed on the outer circumference of the motor. A second radiation fin extending in the axial direction of the output shaft is formed on the outer circumference of the radiator. The first and second radiation fins are aligned along the flow of cooling air. This structure restrains the resistance against the flow of cooling air at the boundary between the first and second radiation fins. Therefore, the flow of cooling air easily reaches the both first and second radiation fins, even if the flow of cooling air is used for cooling both the motor and the radiator.

Further, the fluid pressure pump unit is structured as follows. Namely, a unit cover covering the periphery of the first and second radiation fins is provided. With the structure, the first and second radiation fins and the unit cover form a passage for the flow of cooling air, thereby preventing dispersion of the flow of cooling air. Therefore, the flow of cooling air more easily reaches the both first and second radiation fins, even if the flow of cooling air is used for cooling both the motor and the radiator.

The second aspect of the present invention provides a fluid pressure pump unit structured as follows. Namely, the fluid pressure pump unit includes: a fluid pressure pump which pressurizes a hydraulic fluid; a motor which has an output shaft and drives the fluid pressure pump; and a cooling fan which is connected to the output shaft of the motor and generates a flow of cooling air to cool the motor. A passage for a flow of the hydraulic fluid is formed in a housing of the motor. This structure allows heat transfer from the hydraulic fluid to the housing of the motor, thus contributing to cooling of the hydraulic fluid.

DESCRIPTION OF THE REFERENCE NUMERALS

1 Hydraulic Equipment
2 Hydraulic Cylinder
3 Hydraulic Pump Unit
4 Hydraulic Pump
5 Motor
5*a* Output Shaft of Motor
6 Flow of Cooling Air
7 Cooling Fan
8 Radiator

BEST MODE FOR CARRYING OUT THE INVENTION

The following describes an embodiment of the present invention with reference to attached drawings.

Figure 4:
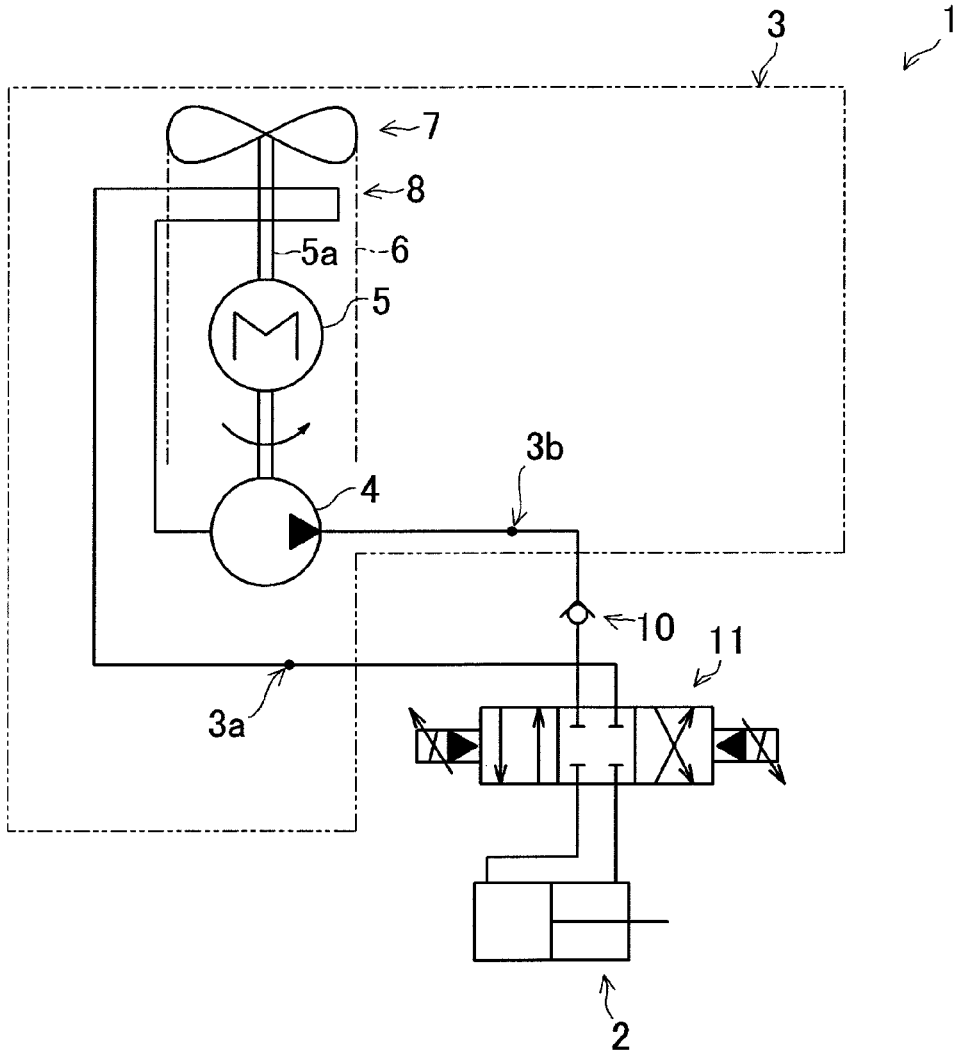
FIG. 4 is a diagram of a hydraulic circuit.

First described with reference to FIG. 4 is hydraulic equipment 1 adopting one embodiment of a hydraulic pump unit (fluid pressure pump unit), according to the present invention. FIG. 4 is a diagram illustrating a hydraulic circuit.

As illustrated in this figure, the hydraulic equipment 1 of the present embodiment includes: a double-acting hydraulic cylinder 2 serving as a hydraulic actuator; and a hydraulic pump unit 3 for supplying pressure oil to the hydraulic cylinder 2.

The hydraulic pump unit 3 essentially has: a hydraulic pump 4 (fluid pressure pump) which pressurizes a hydraulic oil (hydraulic fluid); a motor 5 which has an output shaft 5*a* and drives the hydraulic pump 4; a cooling fan 7 which is connected to the output shaft 5*a* of the motor 5 and generates a flow of cooling air 6 schematically illustrated by an alternate long and short dash line to cool the motor 5; and a radiator 8 for receiving heat from the hydraulic oil (hydraulic fluid). Indicated by reference numbers 10 and 11 are respectively a pump check valve and a three-position four-port directional valve. These pump check valve 10 and three-position four-port directional valve 11 are for controlling the operation of the hydraulic cylinder 2.

Figure 1:
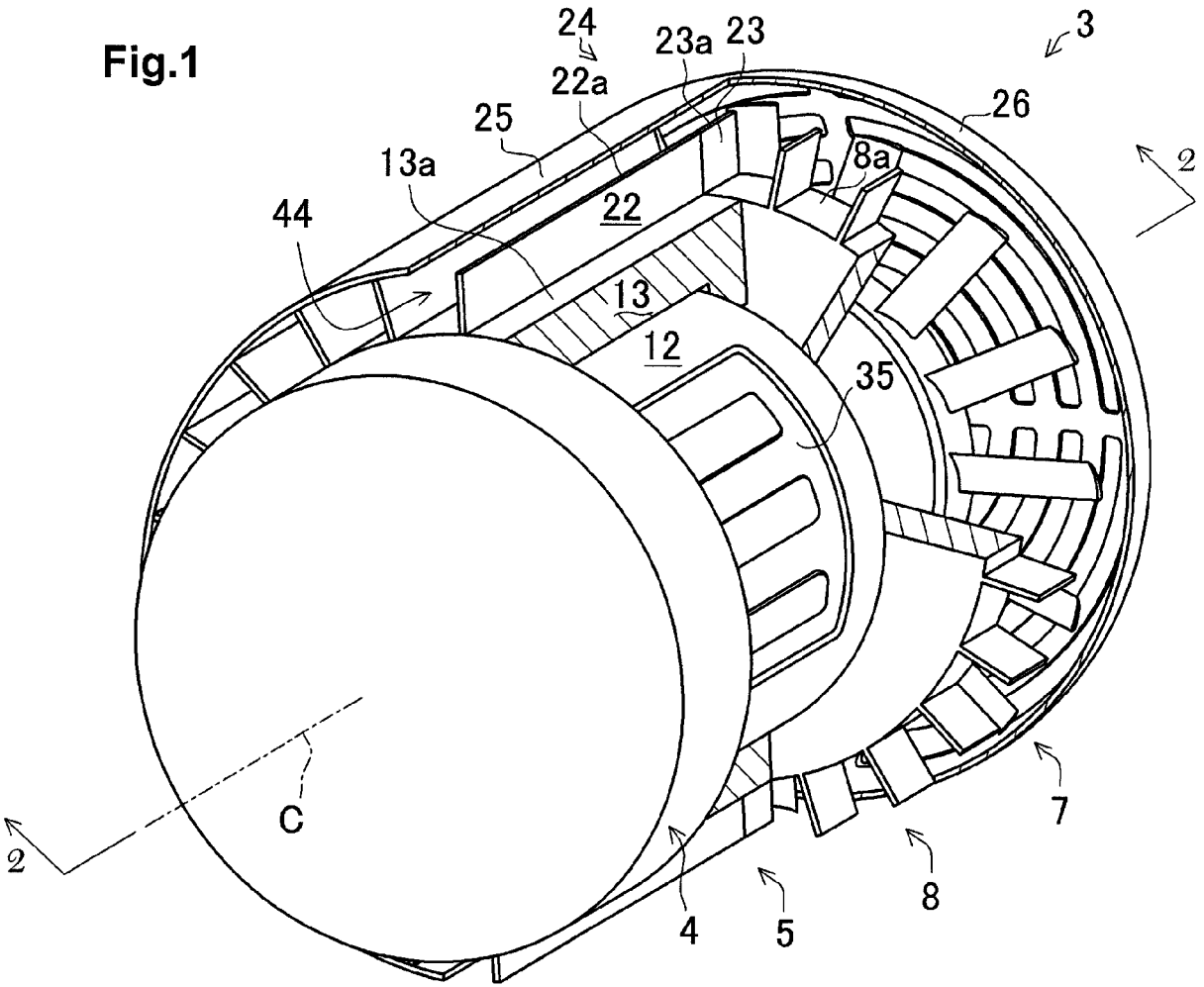
FIG. 1 is a broken-away fragmentary perspective view illustrating an embodiment of a hydraulic pump unit, according to the present invention.
Figure 2:
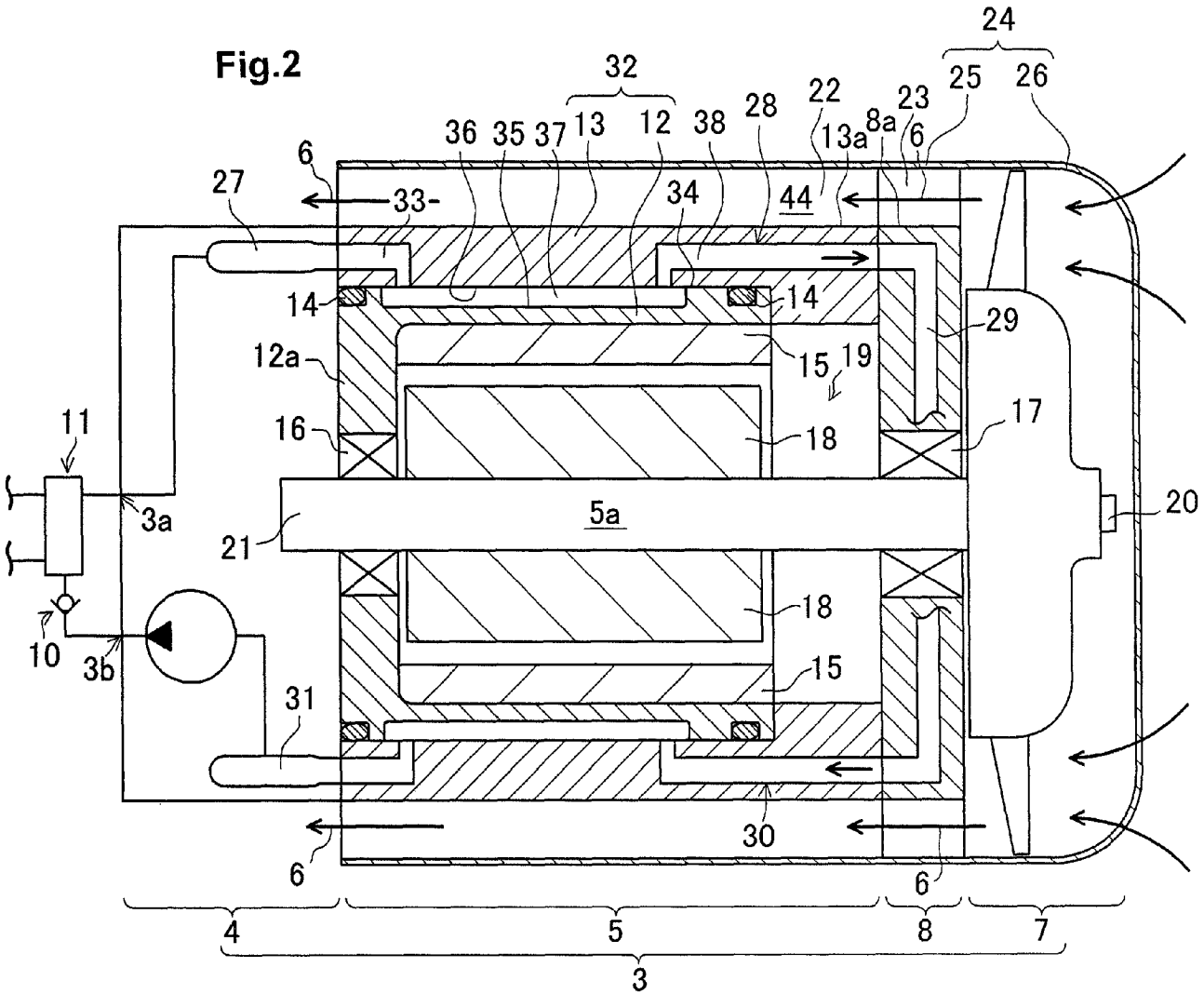
FIG. 2 is a cross sectional view taken along the line 2-2 of FIG. 1.
Figure 3:
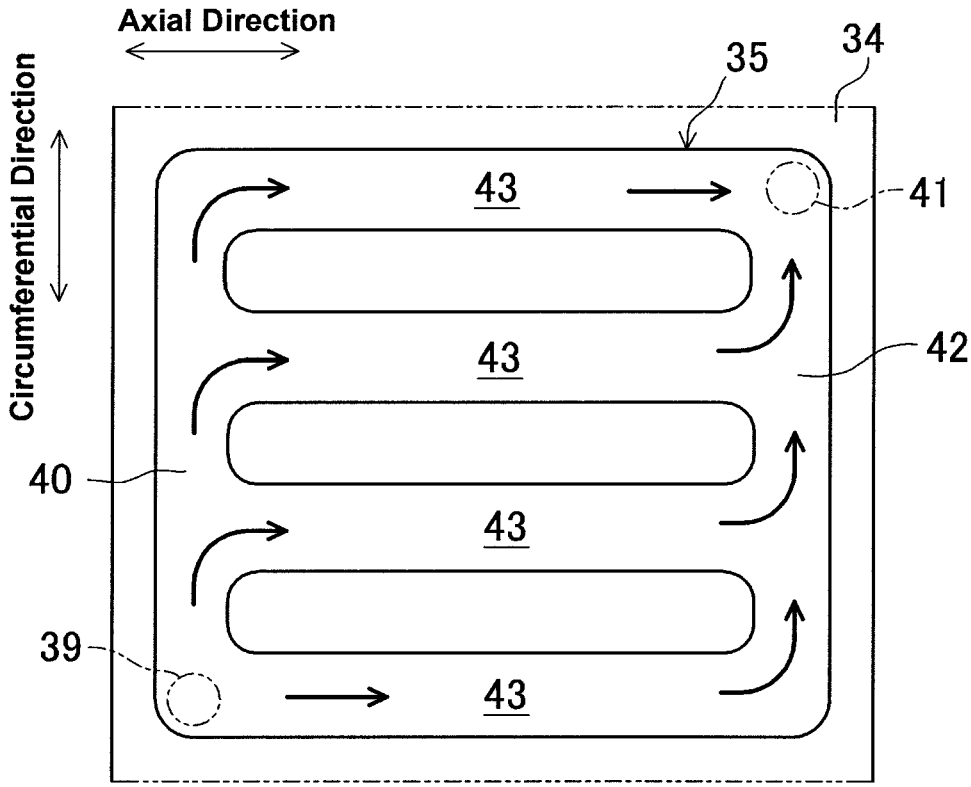
FIG. 3 is a partially exploded view of the inside housing.

Next, the structure of the hydraulic pump unit 3 is further detailed with reference to FIGS. 1 to 3. FIG. 1 is a broken-away fragmentary perspective view illustrating the one embodiment of a hydraulic pump unit according to the present invention. FIG. 2 is a cross sectional view taken along the line 2-2 of FIG. 1. FIG. 3 is a partial exploded view of an inside housing.

See FIG. 2 first. As illustrated in this figure, a housing 32 of the motor 5 is constituted by an inside housing 12 (first housing), and an outside housing 13 (second housing) fitted at the outside of the inside housing 12. Fitting gaps between the inside housing 12 and the outside housing 13 are sealed by a schematically illustrated oil seal 14. On the inner circumferential surface of the inside housing 12 is arranged a stator 15 having an electromagnet (coil).

The cooling fan 7, the radiator 8, motor 5, and hydraulic pump 4 are sequentially aligned in this order in the axial direction of the output shaft 5*a* of the motor 5. That is, the radiator 8 is disposed between the cooling fan 7 and the motor 5, and the hydraulic pump 4 is disposed at the opposite side of the radiator 8 across the motor 5.

The hydraulic pump 4 and the radiator 8 are coaxially fixed by means of not-illustrated screw to the motor 5 so as to interpose therebetween the motor 5. The output shaft 5*a* of the motor 5 is supported by a bearing 16 provided to a flange 12*a* of the inside housing 12 and a bearing 17 provided to the radiator 8. On the outer circumference of the output shaft 5*a* is attached a schematically depicted permanent magnet 18, and this permanent magnet 18 and the output shaft 5*a* form a rotor 19 of the motor 5.

Where an end of the output shaft 5*a* to which the cooling fan 7 is provided is a leading end 20, a base end 21 of the output shaft 5*a* is connected to a driving unit inside the hydraulic pump 4.

In this structure, rotation of the rotor 19 of the motor 5 causes ejection of pressure oil from the hydraulic pump 4 to the directional valve 11 of FIG. 4, rotates the cooling fan 7 of FIG. 2 in a predetermined direction, and generates the flow of cooling air 6 parallel to the axial direction of the output shaft 5*a*. When giving an eye to this flow of cooling air 6, the radiator 8 is located on the windward of the motor 5.

See FIG. 1 for the following. For the sake of convenience, the axis of the not-illustrated output shaft of the motor 5 is given the reference symbol C in the figure. As illustrated, first radiation fins 22 each extending in the direction of the axis C are formed on an outer circumference of the motor 5, and second radiation fins 23 each extending in the direction of the axis C are formed on an outer circumference of the radiator 8. This is more specifically described below. Namely, each first radiation fin 22 has a predetermined height outwardly in a radial direction from an outer circumferential surface 13*a* of the outside housing 13 constituting the housing 32 of the motor 5, and extends along the direction of the axis C. The first radiation fins 22 are arranged at a predetermined interval in the circumferential direction. Similarly, each second radiation fin 23 has a predetermined height outwardly in a radial direction from an outer circumferential surface 8*a* of the radiator 8, and extends along the direction of the axis C. The second radiation fins 23 are arranged at a predetermined interval in the circumferential direction. The predetermined heights of the first radiation fins 22 and the second radiation fins 23 are the same, and the thicknesses of these fins are also the same. Further, the motor 5 and radiator 8 are circumferentially positioned around the axis C so that each first radiation fin 22 and each second radiation fin 23 are aligned along the flow of cooling air 6, in other words, unevenness between each first radiation fin 22 and each second radiation fin 23 is prevented, that is, each first radiation fin 22 and each second radiation fin 23 smoothly connect with each other.

The hydraulic pump unit 3 further has a unit cover 24 which covers the periphery of the first and second radiation fins 22 and 23. This unit cover 24 has a cylindrical part 25 which covers the periphery of the first and second radiation fins 22 and 23 in such a manner that the cylindrical part 25 abuts the outer edges 22*a* of the first radiation fins 22 and the outer edges 23*a* of the second radiation fins 23; and a protection cover 26 provided mainly for the safety purpose. On the protection cover 26 are formed a number of slits as illustrated. In this structure, a quadrangular prism-shaped passage 44 for the flow of cooling air 6 generated by the rotation of the cooling fan 7 is formed by: two first radiation fins 22 circumferentially adjacent to each other; two second radiation fins 23 circumferentially adjacent to each other; the outer circumferential surface 13*a* of the outside housing 13; the outer circumferential surface 8*a* of the radiator 8; and the cylindrical part 25.

Further, as illustrated in FIG. 2, the motor 5 and radiator 8 are disposed coaxially with the cooling fan 7 so that the motor 5 and the radiator 8 are overlapped with the cooling fan 7, when viewed from the axial direction of the output shaft 5*a* of the motor 5. That is, concentric circles are conceivable when viewing the cooling fan 7, the radiator 8, and the motor 5 from the axial direction of the output shaft 5*a* of the motor 5 (see also FIG. 1).

Next, the following details the passage of the hydraulic oil inside the hydraulic pump unit 3.

See FIG. 2 for the following. As illustrated in this figure, the hydraulic oil ejected from the hydraulic cylinder 2 (see also FIG. 4) is fed into a first inlet/outlet port 3*a* of the hydraulic pump unit 3 through the directional valve 11, and then fed into a cooling passage 29 inside the radiator 8, sequentially through a passage 27 in the hydraulic pump 4 and a communication passage 28 formed in the motor 5. The hydraulic oil having been cooled in the cooling passage 29 is then fed into a passage 31 in the hydraulic pump 4 through a communication passage 30 formed in the motor 5, after which the hydraulic oil is ejected from a second inlet/outlet port 3*b* of the hydraulic pump unit 3 and supplied to the hydraulic cylinder 2 through the pump check valve 10 and the directional valve 11.

As described, the passages 27 and 31 in the hydraulic pump 4 and the cooling passage 29 in the radiator 8 are in communication with one another through the communication passages 28 and 30 formed in the motor 5. These communication passages 28 and 30 are formed inside the housing 32 of the motor 5. Specifically, the housing 32 of the motor 5 has the inside housing 12 and the outside housing 13 as is mentioned hereinabove, and the communication passage 28 includes a first passage 33, a second passage 37, and a third passage 38. The first passage 33 is formed in the outside housing 13 by boring, and communicates with the passage 27 in the hydraulic pump 4. The second passage 37 is formed by a groove 35 carved on the outer circumferential surface 34 of the inside housing 12 and the inner circumferential surface 36 of the outside housing 13, and communicates with the first passage 33. The third passage 38 is formed in the outside housing 13 by boring, and connects the second passage 37 with the cooling passage 29 in the radiator 8. The communication passage 30 is structured in substantially the same manner as the communication passage 28.

Next, the following details with reference to FIG. 3 the groove 35 which is carved on the outer circumferential surface 34 of the inside housing 12, and is a constituting element of the second passage 37 forming a part of the communication passage 28. FIG. 3 is a partial exploded view of the outer circumferential surface 34 of the inside housing 12. The circumferential direction of the inside housing 12 correspond to the up/down direction in the figure. This figure only presents a half of the exploded outer circumferential surface 34, and the straight long dashed double-short dashed line in the figure represents the boundary with the other half of the exploded outer circumferential surface 34 whose illustration has been omitted.

As illustrated in the figure, the groove 35 includes a circumferential groove 40, a circumferential groove 42, and a plurality of communication grooves 43. The circumferential groove 40 extends in the circumferential direction from a junction 39 at which the groove 35 and the first passage 33 are connected to one other. The circumferential groove 42 extends in the circumferential direction from a junction 41 at which the groove 35 and the third passage 38 are connected to one other. The communication grooves 43 extend in the axial direction of the output shaft of the motor, and connect the circumferential grooves 40 and 42 extending parallel to each other at predetermined intervals in the circumferential direction, thus discretely. In other words, the groove 35 is formed in substantially a ladder-like shape. Further, considering that the groove 35 does not straightly communicate the junctions 39 and 41, it is possible to express that the communication passage 28 shown in FIG. 2 is formed so as to make a detour in the housing 32 of the motor 5. With the above structure, the hydraulic oil fed into the groove 35 through the junction 39 is fed into each communication groove 43 directly or indirectly via the circumferential groove 40, and fed from the communication groove 43 into the junction 41 directly or indirectly through the circumferential groove 42. Note that each groove 35 has such a large area to cover the inside housing 12 as illustrated in FIG. 1. That is, for example, each groove 35 is formed so as to cover ¼ to ½ of the circumferential surface of the inside housing 12.

Next, the following describes the operation of the present embodiment. The flow of the hydraulic oil has been already described herein above. The following therefore mainly describes heat transfer.

See FIGS. 4 and 2 for the following. The hydraulic oil discharged from the hydraulic cylinder 2 of FIG. 4 during operation of the hydraulic cylinder 2 is heated by frictional heat or the like at the time of passing the directional valve 11 shown in FIG. 2. The high temperature hydraulic oil is supplied to the communication passage 28 formed in the motor 5, through the passage 27 in the hydraulic pump 4. When the high temperature hydraulic oil passes the communication passage 28, the heat of the hydraulic oil is absorbed by the housing 32 of the motor 5 and the hydraulic oil is cooled. Next, the hydraulic oil slightly cooled in the communication passage 28 is fed into the cooling passage 29 in the radiator 8, and strongly cooled by transferring heat to the air-cooled radiator 8. Next, the hydraulic oil having been cooled down in the cooling passage 29 is fed into the communication passage 30 formed in the motor 5. When the hydraulic oil passes the communication passage 30, the heat of the hydraulic oil is absorbed by the housing 32 of the motor 5 and the hydraulic oil is further cooled. After passing the communication passage 30, the hydraulic oil gains energy at the hydraulic pump 4, and is eventually supplied to the hydraulic cylinder 2. Thus, an excessive increase in the temperature of the hydraulic oil is prevented. Note that the temperature of the hydraulic oil is targeted at about 110 deg C., from various technical view point. Further, a result of a known calculation shows that the temperature of the hydraulic oil, at the ambient temperature of 70 deg C., rises approximately up to 170 deg C., if the above cooling is not at all conducted. Note that, the above mentioned constant flow of cooling air 6 generated by rotation of the cooling fan 7 in the passage 44 during the series of the above operation constantly cools the housing 32 of the motor 5 and the radiator 8.

As hereinabove mentioned, the hydraulic pump unit 3 (fluid pressure pump unit) of the above embodiment is structured as follows. Namely, the hydraulic pump unit 3 includes: the hydraulic pump 4 (fluid pressure pump) which pressurizes the hydraulic oil(hydraulic fluid); the motor 5 (motor) which has the output shaft 5*a* and drives the hydraulic pump 4; the cooling fan 7 which is connected to the output shaft 5*a* of the motor 5 and generates the flow of cooling air 6 to cool the motor 5; and the radiator 8 which receives heat from the hydraulic oil. The motor 5 and the radiator 8 are overlapped with the cooling fan 7, when viewed from the axial direction of the output shaft 5*a* of the motor 5. In this structure, the flow of cooling air 6 is utilized not only for cooling the motor 5 but also for cooling the radiator 8, thereby contributing to downsizing of the hydraulic equipment 1. If sufficient cooling effect is achievable with the above structure, there will be no need of providing another cooling device (out-mountable radiator or the like) separately from the hydraulic pump unit 3. This contributes to weight reduction of the hydraulic equipment 1 and simplifies pipe laying in the equipment, thus improving the maintenance characteristics.

Note that the above embodiment deals with hydraulic equipment as an example of a fluid pressure equipment, and uses the expression such as "hydraulic pump unit" and "hydraulic oil" frequently in the explanation in concert with the example; however, the application of the present invention is not limited to hydraulic equipment. Further, in the above embodiment, a motor using an electromagnetic force is mentioned as an example of the motor. The motor however may be an engine utilizing expansional action of combustion. Further, in the above embodiment, the cooling fan 7, radiator 8, and motor 5 are straightly aligned as shown in FIGS. 1, 2, and 4; however, the thought of the present invention is fully utilized as long as the motor 5 and the radiator 8 are overlapped, even by little, with the cooling fan 7, when viewed from the axial direction of the output shaft 5*a* of the motor 5. Further, instead of disposing the radiator 8 between the motor 5 and the cooling fan 7, the radiator 8 may be disposed between the hydraulic pump 4 and the motor 5, or disposed at the opposite side of the motor 5 across the cooling fan 7.

The hydraulic pump unit 3 is further structured as follows. Namely, the radiator 8 is disposed between the cooling fan 7 and the motor 5. This structure, which gives more priority to cooling of the radiator 8 over cooling of the motor 5, excels in cooling the hydraulic oil. Because, when giving eye to the flow of cooling air 6 generated by the cooling fan 7, the radiator 8 is located the windward of the motor 5.

The hydraulic pump unit 3 is further structured as follows. Namely, the hydraulic pump 4 is disposed at the opposite side of the radiator 8 across the motor 5. The passages 27 and 31 in the hydraulic pump 4 and the cooling passage 29 (passage) in the radiator 8 are in communication with one another through the communication passages 28 and 30 formed in the motor 5. In the above structure, a special plumbing communicating the passages 27 and 31 in the hydraulic pump 4 with the cooling passage 29 in the radiator 8 is formed in the motor 5. This structure contributes to weight reduction and improvement of maintenance characteristic, compared to a case of providing the plumbing outside the motor 5.

The hydraulic pump unit 3 is further structured as follows. Namely, the communication passages 28 and 30 are formed in the housing 32 of the motor 5. Although the communication passages 28 and 30 are formed inside the motor 5, the basic operation of the motor 5 is not affected. Further with the structure, heat is transferred from the hydraulic oil flowing in the communication passages 28 and 30 to the housing 32 of the motor 5, thereby contributing to cooling of the hydraulic oil.

The hydraulic pump unit 3 is further structured as follows. Namely, the housing 32 of the motor 5 includes the inside housing 12 (first housing) and the outside housing 13 (second housing) fitted at the outside of the inside housing 12. The second passage 37 which is a part of the communication passage 28 (or communication passage 30) includes the groove 35 as its constituting element, the groove 35 being formed on the outer circumferential surface 34 of the inside housing 12. This structure allows easier formation of the communication passage 28 (communication passage 30).

Instead of the above structure, the second passage 37 which is a part of the communication passage 28 may include a groove carved on the inner circumferential surface 36 of the outside housing 13, or include both this groove and the above mentioned groove 35. In the former case, that is, a case of including the groove formed on the inner circumferential surface 36, the second passage 37 is formed, for example, by that groove and the outer circumferential surface 34 of the inside housing 12. In the latter case, the second passage 37 may be structured by a combination of that groove and the above mentioned groove 35 which face with each other.

Further, in the embodiment, only the second passage 37 which is a part of the communication passage 28 has the groove 35 as its constituting element, and the other parts, namely the first and third passages 33 and 38, do not have such a groove as their constituting element. However, it is possible that the entire communication passage 28 has, as its constituting element, a groove carved on at least one of the outer circumferential surface 34 of the inside housing 12 and the inner circumferential surface 36 of the outside housing 13.

The hydraulic pump unit 3 is further structured as follows. Namely, the communication passages 28 and 30 are formed so as to make a detour inside the housing 32 of the motor 5. The structure ensures a large contact area between the hydraulic oil flowing in the communication passages 28 and 30 and the housing 32 of the motor 5, thereby enhancing heat transfer from the hydraulic oil to the housing 32.

Note that, in the above embodiment, the communication passage 28 shown in FIG. 3 is formed so as to largely make a detour at the second passage 37 formed in a ladder-like shape. Instead however, the communication passage 28 may be formed as a passage smoothly meandering like a sine wave, or as a passage meandering in a step-like manner like a square wave.

The hydraulic pump unit 3 is further structured as follows. Namely, the first radiation fin 22 extending in the axial direction of the output shaft 5*a* is formed on the outer circumference of the motor 5. The second radiation fin 23 extending in the axial direction of the output shaft 5*a* is formed on the outer circumference of the radiator 8. The first and second radiation fins 22 and 23 are aligned along the flow of cooling air 6. This structure restrains the resistance against the flow of cooling air 6 at the boundary between the first and second radiation fins 22 and 23. Therefore, the flow of cooling air 6 easily reaches the both first and second radiation fins 22 and 23, even if the flow of cooling air 6 is used for cooling both the motor 5 and the radiator 8.

The hydraulic pump unit 3 is further structured as follows. Namely, the unit cover 24 covering the periphery of the first and second radiation fins 22 and 23 is provided. With the structure, the first and second radiation fins 22 and 23 and the unit cover 24 form the passage 44 for the flow of cooling air 6, thereby preventing dispersion of the flow of cooling air 6. Therefore, the flow of cooling air 6 more easily reaches the both first and second radiation fins 22 and 23, even if the flow of cooling air 6 is used for cooling both the motor 5 and the radiator 8.

Further, as illustrated in FIG. 2, the communication passages 28 and 30 for the flow of the hydraulic oil are formed inside the housing 32 of the motor 5. This structure allows heat transfer from the hydraulic oil to the housing 32 of the motor 5, thus contributing to cooling of the hydraulic oil.

Thus described suitable embodiment of the present invention may be changed as follows.

Namely, for example, the hydraulic equipment 1 of the above embodiment includes a double-acting hydraulic cylinder 2. However, the hydraulic equipment 1 may adopt a single-acting hydraulic cylinder in place of the double-acting hydraulic cylinder 2.

What is claimed is:

1. A fluid pressure pump unit, comprising:

a fluid pressure pump which pressurizes a hydraulic fluid;

a motor which has an output shaft and drives the fluid pressure pump;

a cooling fan which is connected to the output shaft of the motor and generates a flow of cooling air to cool the motor;

a radiator which receives heat from the hydraulic fluid, wherein the motor and the radiator are overlapped at least partially with the cooling fan, when viewed from an axial direction of the output shaft of the motor;

the radiator is disposed between the cooling fan and the motor;

the fluid pressure pump is disposed at the opposite side of the radiator across the motor;

a passage for the hydraulic fluid pressure pump and a passage for the hydraulic fluid in the radiator are in communication with each other through a communication passage formed in a housing of the motor;

the housing of the motor includes a first housing and a second housing fitted at the outside of the first housing; and at least a part of the communication passage includes a groove as its constituting element, the groove being formed on one of an outer circumferential surface of the first housing and an inner circumferential surface of the second housing.

2. The fluid pressure pump unit according to claim 1, wherein the communication passage is formed so as to make a detour inside the housing of the motor.

3. The fluid pressure pump unit according to claim 1, wherein a first radiation fin extending in the axial direction of the output shaft is formed on the outer circumference of the motor, a second radiation fin extending in the axial direction of the output shaft is formed on the outer circumference of the radiator, and the first and second radiation fins are aligned along the flow of cooling air.

4. The fluid pressure pump unit according to claim 3, further comprising a unit cover covering the periphery of the first and second radiation fins.

5. The fluid pressure pump unit according to claim 1, wherein a first radiation fin extending in the axial direction of the output shaft is formed on the outer circumference of the motor, a second radiation fin extending in the axial direction of the output shaft is formed on the outer circumference of the radiator, and the first and second radiation fins are aligned along the flow of cooling air.

* * * * *